US010931037B2

(12) United States Patent
Txarola et al.

(10) Patent No.: US 10,931,037 B2
(45) Date of Patent: Feb. 23, 2021

(54) DUAL CONTACT IDC HEADER PIN

(71) Applicant: J.S.T. CORPORATION, Farmington Hills, MI (US)

(72) Inventors: Joseph Txarola, Farmington Hills, MI (US); Gwendolyn Upson, Ypsilanti, MI (US); Ping Chen, Novi, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 0 days.

(21) Appl. No.: 16/521,322

(22) Filed: Jul. 24, 2019

(65) Prior Publication Data

US 2020/0036109 A1 Jan. 30, 2020

Related U.S. Application Data

(60) Provisional application No. 62/702,988, filed on Jul. 25, 2018.

(51) Int. Cl.

| | |
|---|---|
| ***H01R 4/2425*** | (2018.01) |
| ***H01R 4/2429*** | (2018.01) |
| ***H01R 12/58*** | (2011.01) |
| ***H01R 13/50*** | (2006.01) |
| ***H01R 13/05*** | (2006.01) |
| ***H01R 13/11*** | (2006.01) |
| ***H01R 12/55*** | (2011.01) |

(52) U.S. Cl.

CPC ..... *H01R 4/2425* (2013.01); *H01R 4/2429* (2013.01); *H01R 12/55* (2013.01); *H01R 12/585* (2013.01); *H01R 13/05* (2013.01); *H01R 13/11* (2013.01); *H01R 13/50* (2013.01)

(58) Field of Classification Search

CPC ..... H01R 4/245–2466; H01R 12/585; H01R 12/55; H01R 9/092; H01R 13/50; H01R 13/05; H01R 13/11

USPC ..... 439/82, 751, 397, 399, 401

See application file for complete search history.

(56) References Cited

U.S. PATENT DOCUMENTS 3,845,455 A * 10/1974 Shoemaker ..... H01R 4/2458 439/399
3,975,072 A * 8/1976 Ammon ..... H01R 12/58 439/70
4,171,858 A * 10/1979 Knowles ..... H01R 12/675 439/397
4,261,629 A * 4/1981 Reynolds ..... H01R 4/2462 439/82

(Continued)

*Primary Examiner* — Gary F Paumen
(74) *Attorney, Agent, or Firm* — Kratz, Quintos & Hanson, LLP

(57) ABSTRACT

A dual contact Insulation Displacement Contact (IDC) header pin comprised of an upper section, a lead-in section, and a retention section. The upper section of the pin has at a plurality of pin barbs to allow it to be retained into a housing. The side walls and back of the upper portion create a C-shape to the upper portion. Each IDC header pin has two blades to contact a wire and displace the insulation thereof. The lead-in section serves to lead the IDC header pin into a housing and prevent stubbing of the pin during insertion. The retention section of the pin has a plurality of rib-like projections allowing the pin to be retained into respective holes in a PCB by applying normal force and an interference fit. An embodiment is open, with front protrusions on the upper section, and another embodiment is closed, having two front walls on the upper section.

10 Claims, 20 Drawing Sheets

(56) References Cited

U.S. PATENT DOCUMENTS

| | | | | | |
|---|---|---|---|---|---|
| 4,363,529 | A * | 12/1982 | Loose | H01R 12/7058 | 439/82 |
| 4,752,250 | A * | 6/1988 | Seidler | H01R 12/585 | 29/882 |
| 4,894,031 | A * | 1/1990 | Damon | H01R 43/205 | 206/716 |
| 5,021,012 | A * | 6/1991 | Shibano | H01R 4/2466 | 439/397 |
| 5,616,047 | A * | 4/1997 | Lutsch | H01R 4/2466 | 439/395 |
| 6,419,518 | B1 * | 7/2002 | Dittman | H01R 4/2458 | 439/395 |
| 2002/0094708 | A1 * | 7/2002 | Budman | H01R 12/585 | 439/82 |
| 2003/0054684 | A1 * | 3/2003 | Yamanashi | H01R 4/2466 | 439/397 |
| 2003/0124886 | A1 * | 7/2003 | Reisdorf | H01R 13/05 | 439/82 |

* cited by examiner

DUAL CONTACT IDC HEADER PIN

CROSS-REFERENCE TO RELATED APPLICATIONS

This application claims priority of U.S. provisional application No. 62/702,988, filed Jul. 25, 2018.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention generally relates to the field of electrical connectors, which are useful in automotive applications, or the like.

2. Description of the Related Art

An insulation-displacement contact (IDC) is an electrical contact designed to be connected to the conductor(s) of an insulated cable by a connection process that forces a selectively sharpened blade or blades through the insulation, bypassing the need to strip the conductors of insulation before connecting. A solderless retention feature such as an action pin and/or compliant pin adheres to a PCB through the application of normal force and interference fit. Insulation Displacement Contact header pins (IDC header pins) are used in connector systems. In use, during an insertion process, the IDC header pins are placed into a housing and secured, allowing the housing to then be attached to a circuit board using a retention end of the pin, with no solder, and have wires (conductors) inserted into the blades thereof. In many examples of the related art, when header pins are inserted into a housing, the securing of the header pins requires an additional component, such as a plastic cover or pronged terminal system.

Attempts to address this problem have been made. For example, U.S. patent Publication Ser. No. 16/174,825, entitled "IDCC CONNECTION SYSTEM AND PROCESS", Txarola et al. on Oct. 30, 2018, discloses an Insulation Displacement Contact Compliant (IDC) pin system, which includes a housing, header pins, and a printed circuit board (PCB). Each header pin has at least a single barb to be retained into the housing, a blade for contacting a wire, and a retention feature to retain itself into a PCB. The housing also has a negative space similarly shaped to the pin. When the system is fully assembled, the pins will reside in the housing, and exit through the housing and into and through respective holes in a PCB. A wire can then be inserted into the housing once the pin resides within, as well as several options for the assembly process including a) a pin-to-housing insertion process; b) a housing assembly-to-PCB process or a connector-to-PCB process; and c) a wired housing assembly-to-PCB assembly process or a wire harness-to-PCB assembly process.

Accordingly, there still exists a need for a more acceptable IDC pin capable of maintaining a connection with a wire while particularly being able to be secured into a housing without an additional component, such as a plastic cover or pronged terminal system. Many of the features of this invention are designed to ameliorate this problem.

BRIEF SUMMARY OF THE INVENTION

A dual contact Insulation Displacement Contact (IDC) header pin. The IDC header pin is comprised of an upper section, a lead-in section, and a retention section. The IDC header pin has a plurality of pin barbs to allow it to be retained into a housing. The pin barbs anchor the upper section of the IDC header pin into a housing. The upper section of each IDC header pin also has two blades to contact a wire and displace the insulation thereof. The side walls and back of the upper portion create a C-shape to the upper portion. The lead-in section of the pin serves to lead the IDC header pin into a housing and prevent stubbing of the IDC header pin during insertion. The retention section of the pin has a pin retention feature with a plurality of rib-like projections which allows the IDC header pin to be retained into respective holes in a PCB. An embodiment is open, with front protrusions on the upper section, and another embodiment is closed, having two front walls on the upper section.

BRIEF DESCRIPTION OF THE SEVERAL VIEWS OF DRAWINGS

Figure 4:
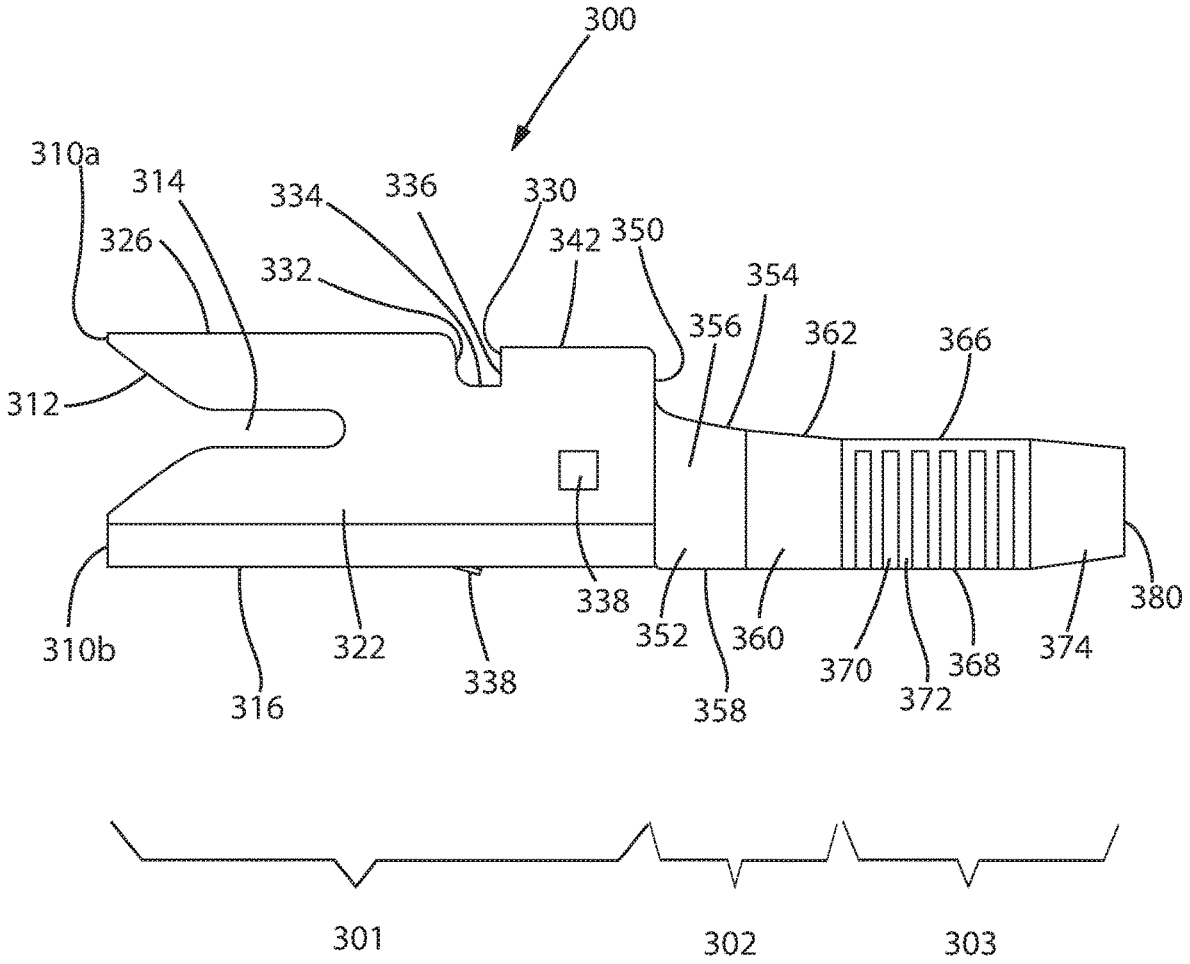
Figure 5:
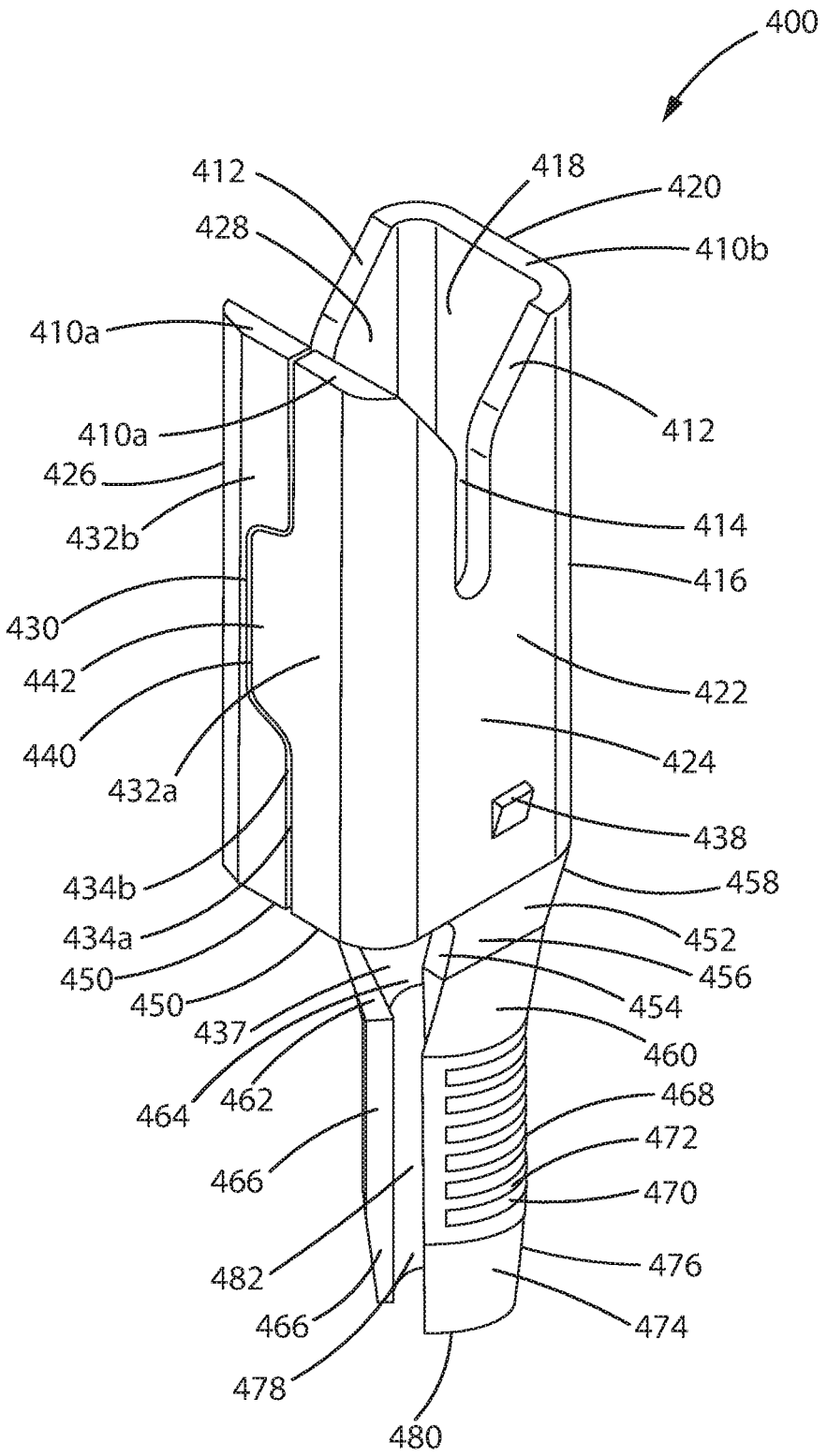
Figure 6:
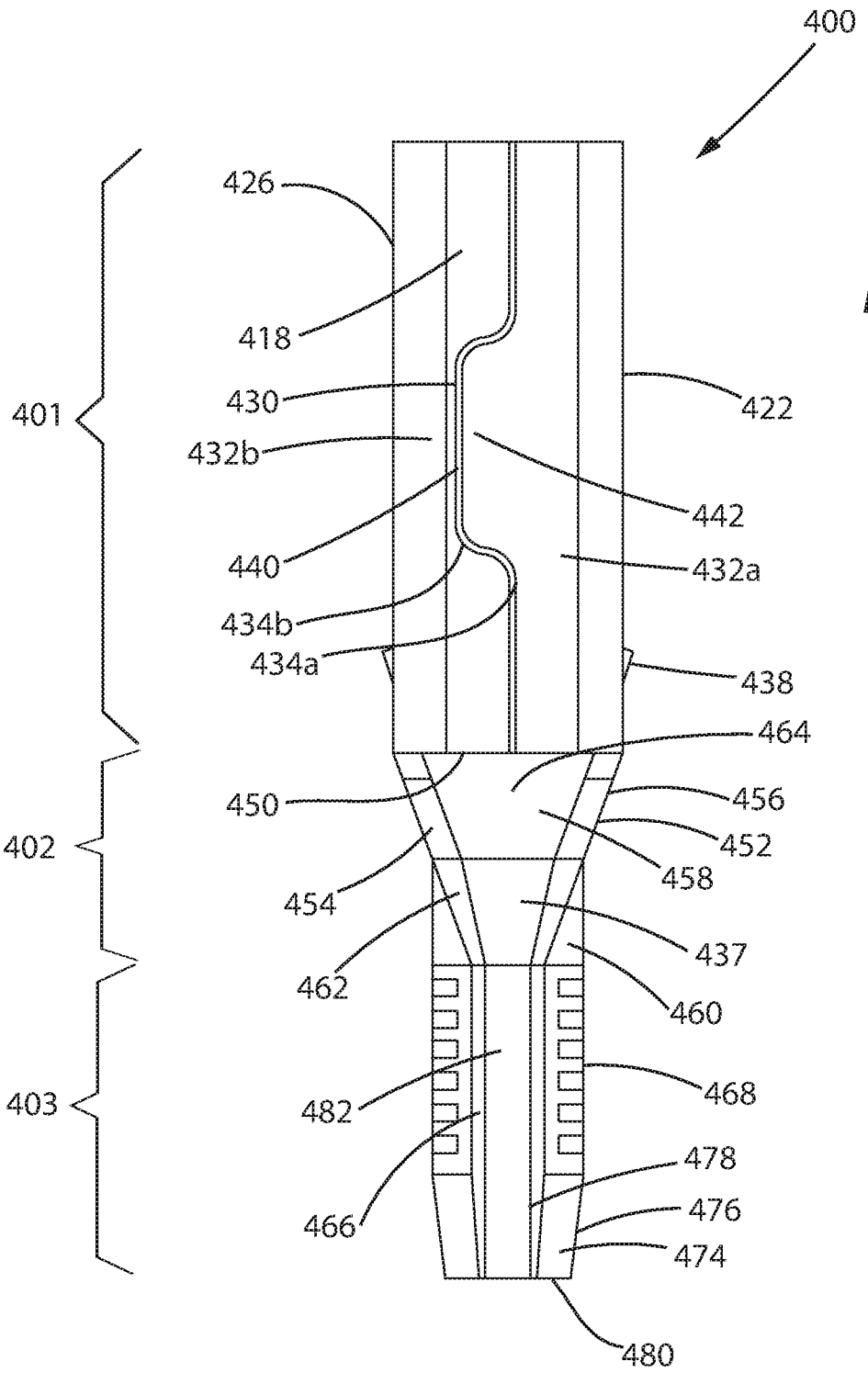
Figure 7A:
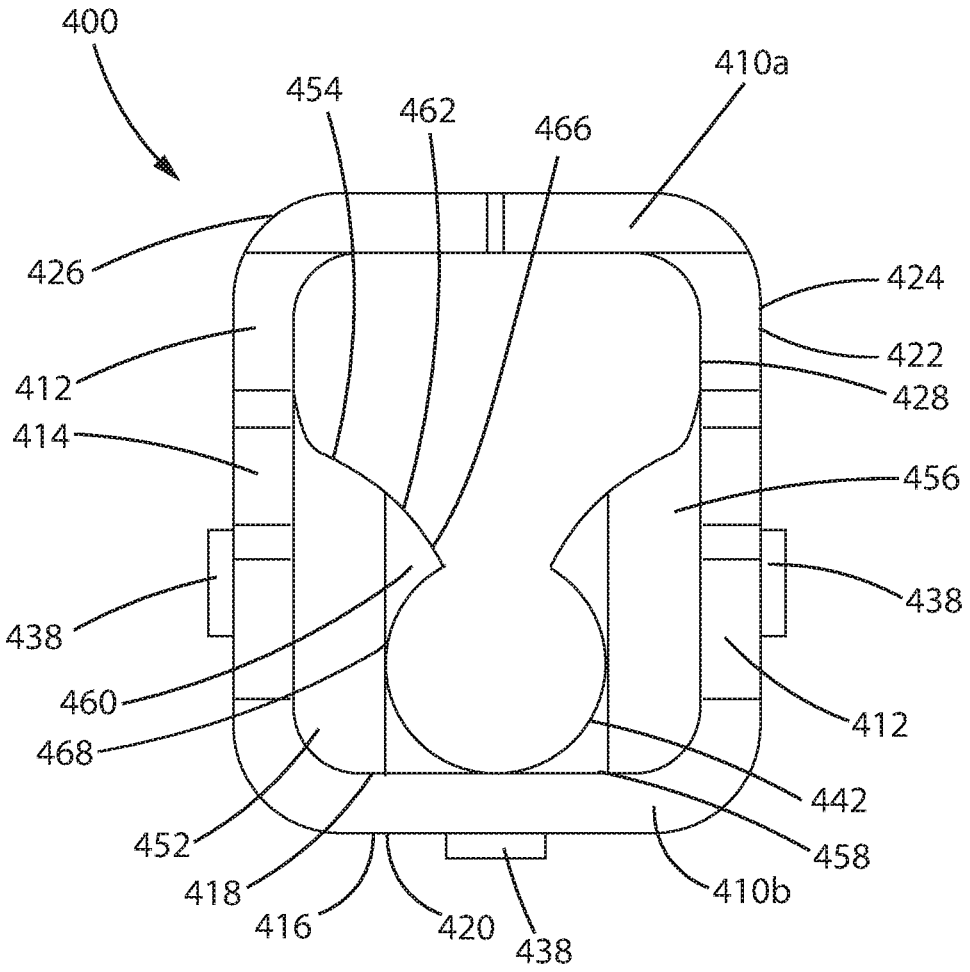
Figure 7B:
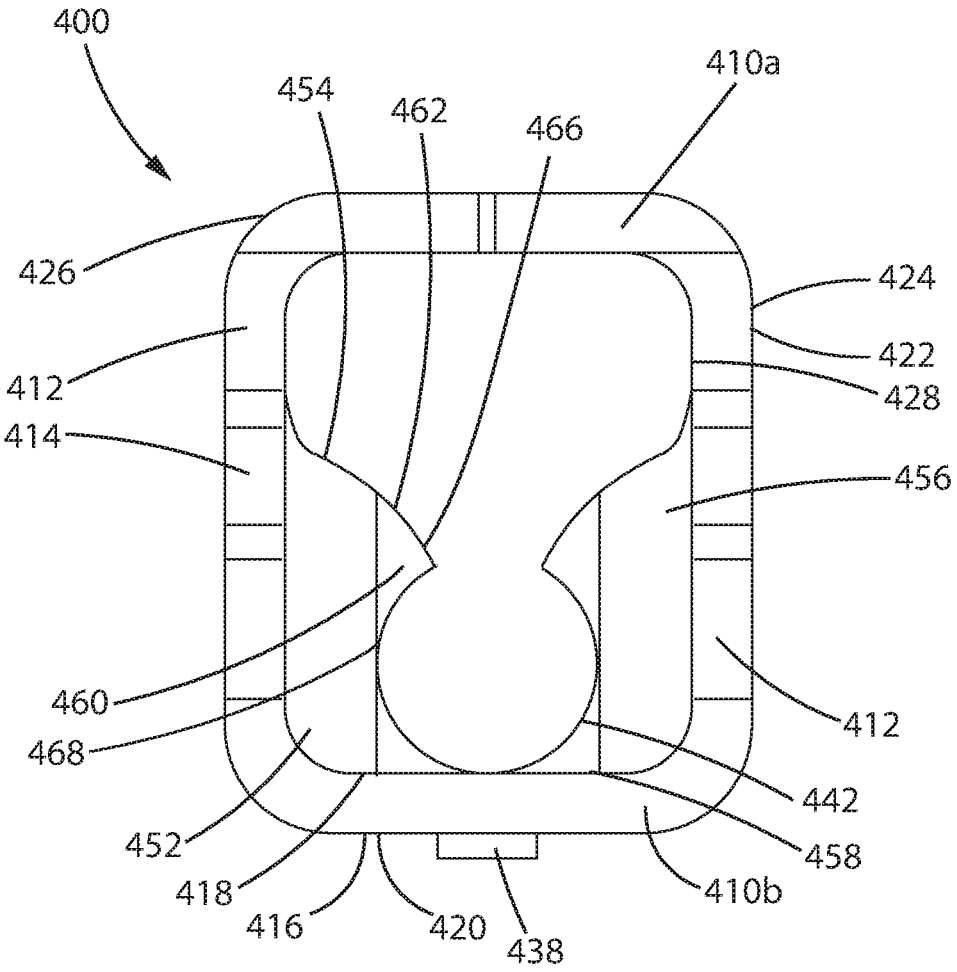
Figure 7C:
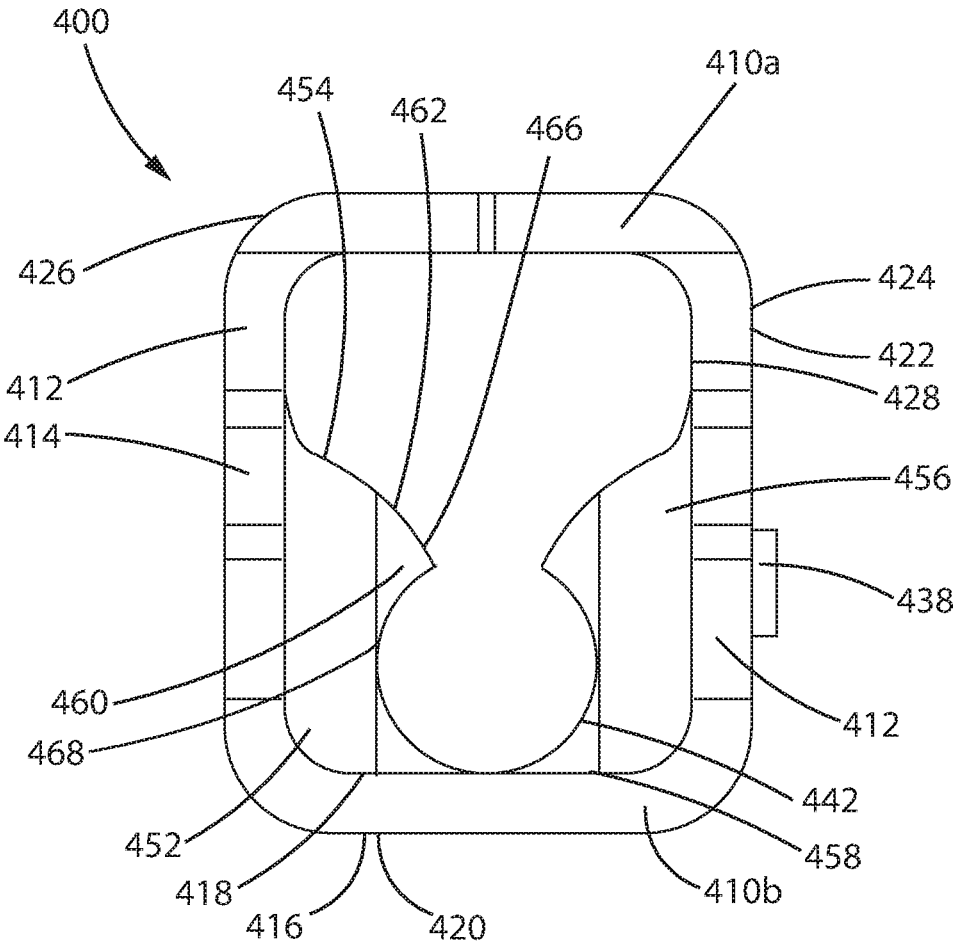
Figure 7D:
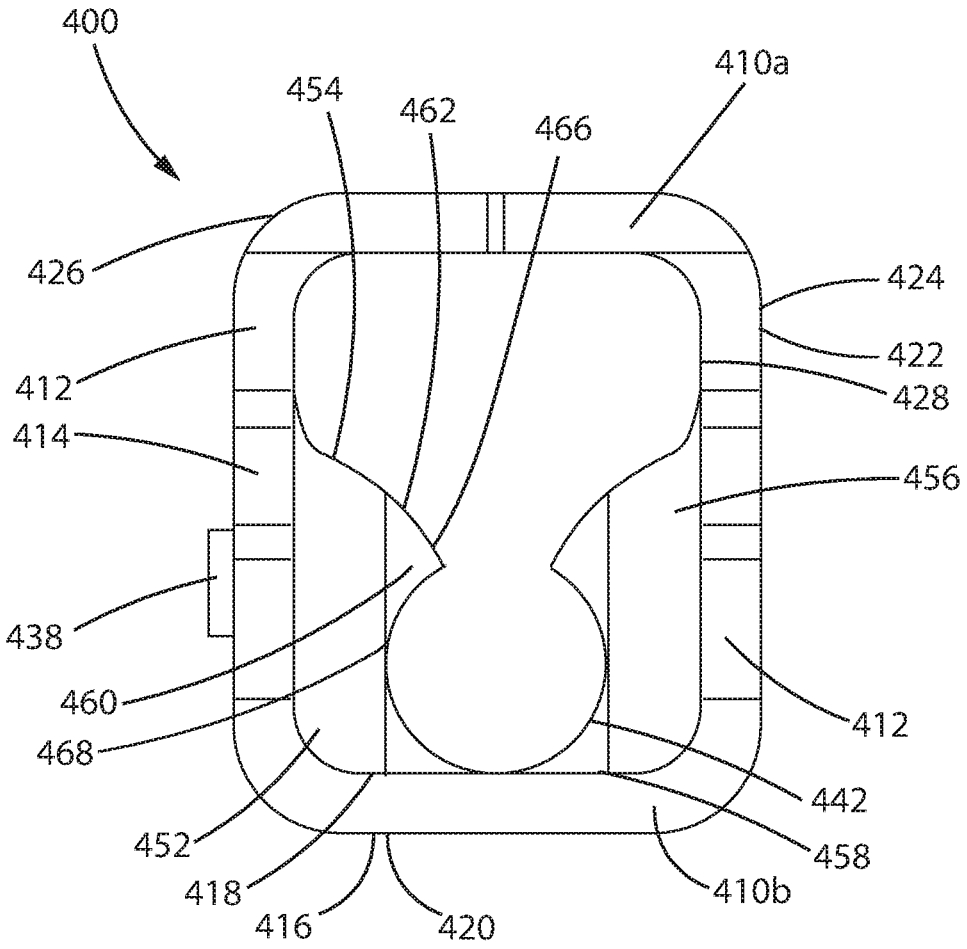
Figure 7E:
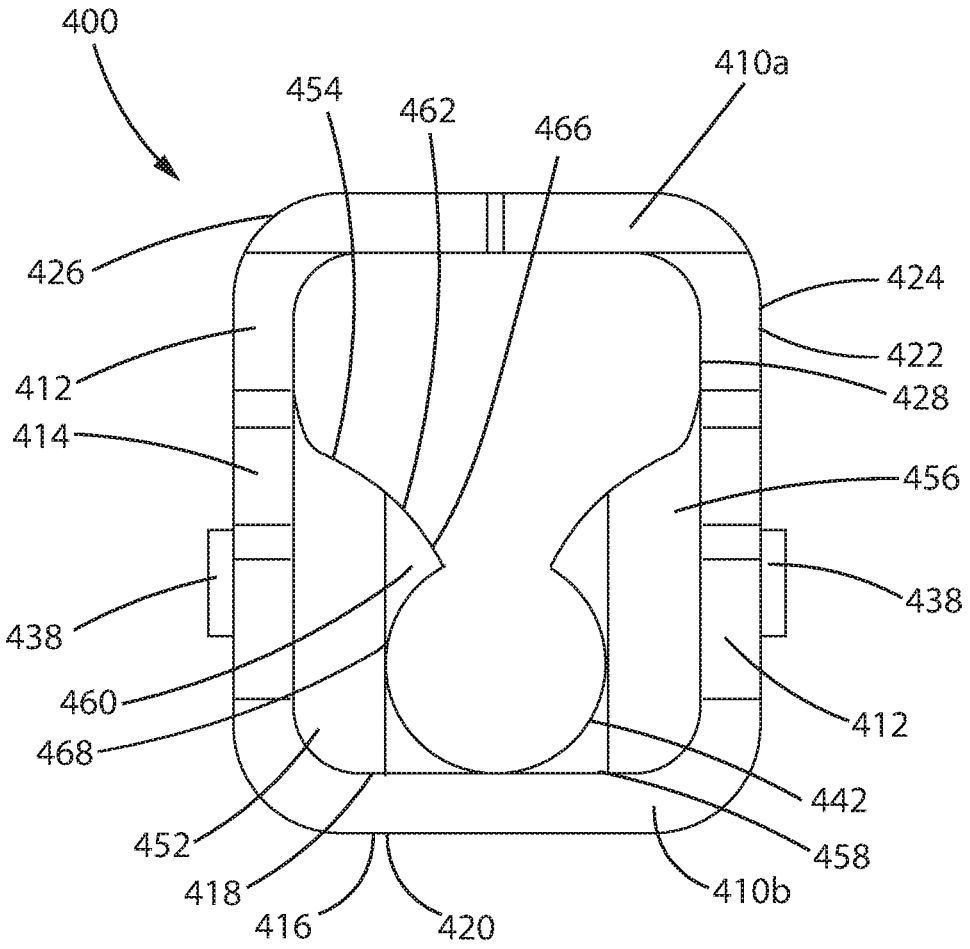
Figure 7F:
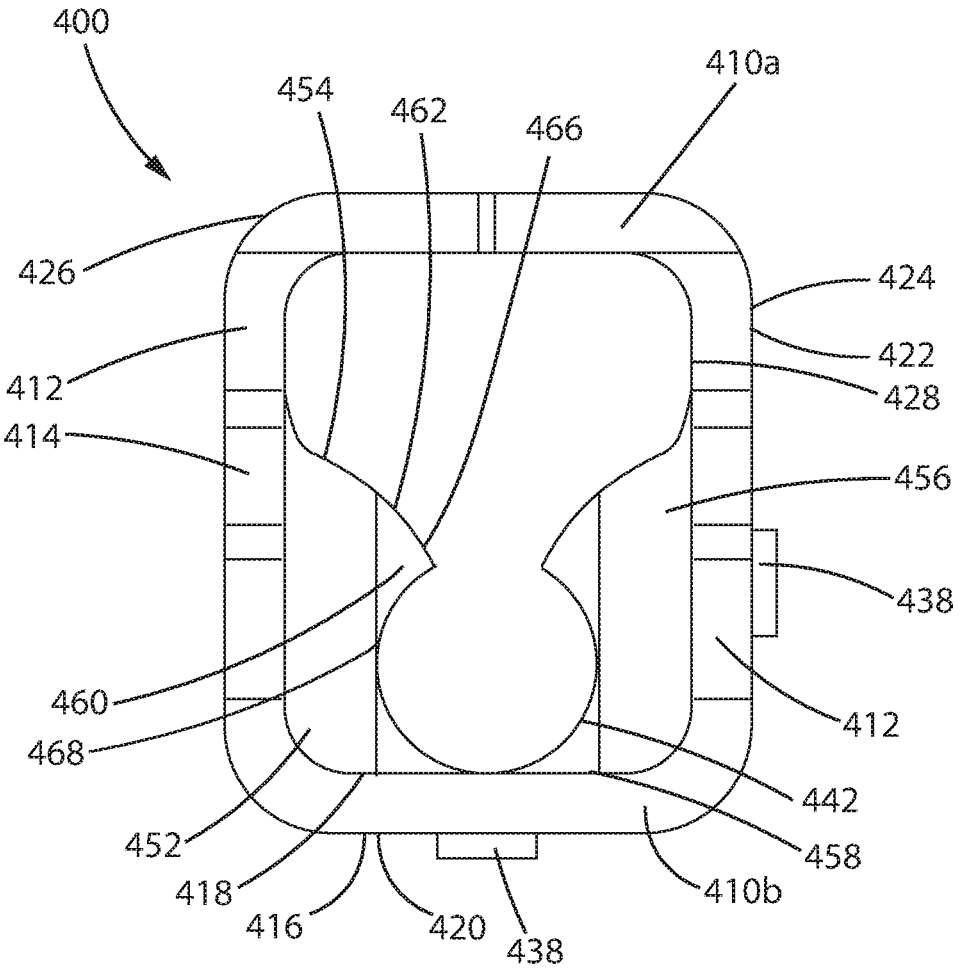
Figure 7G:
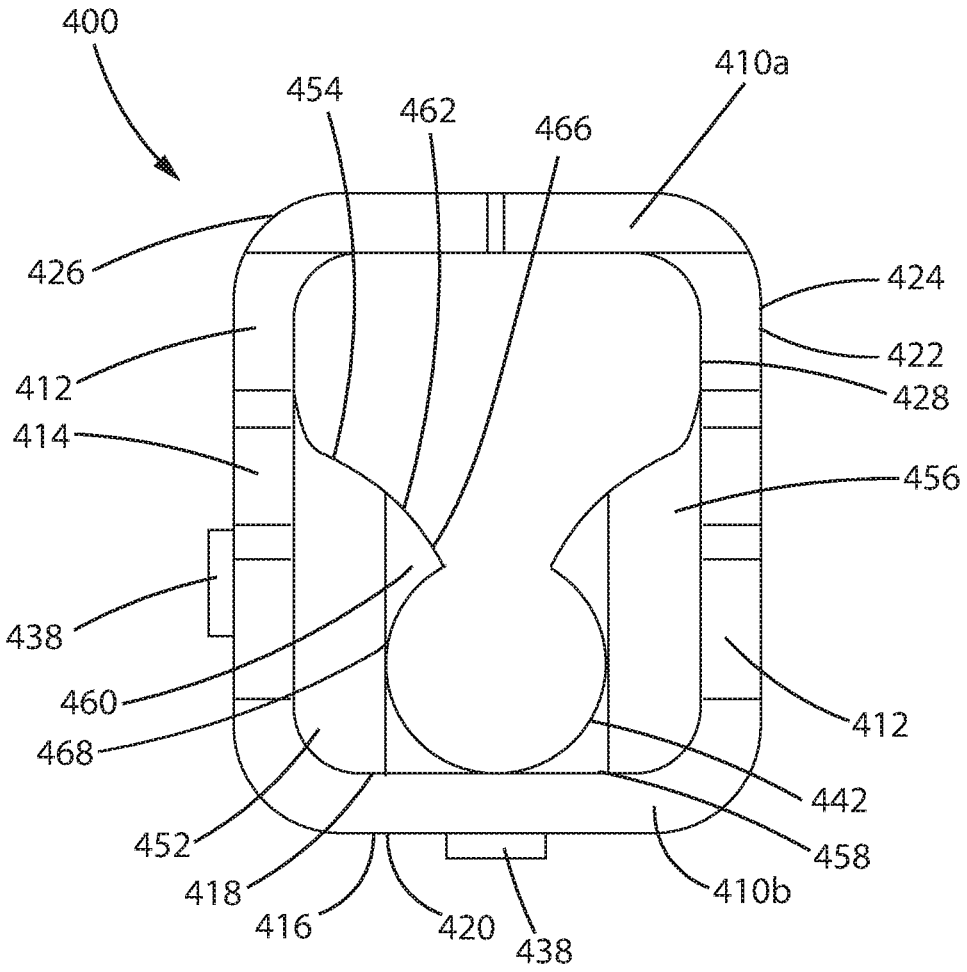
Figure 8:
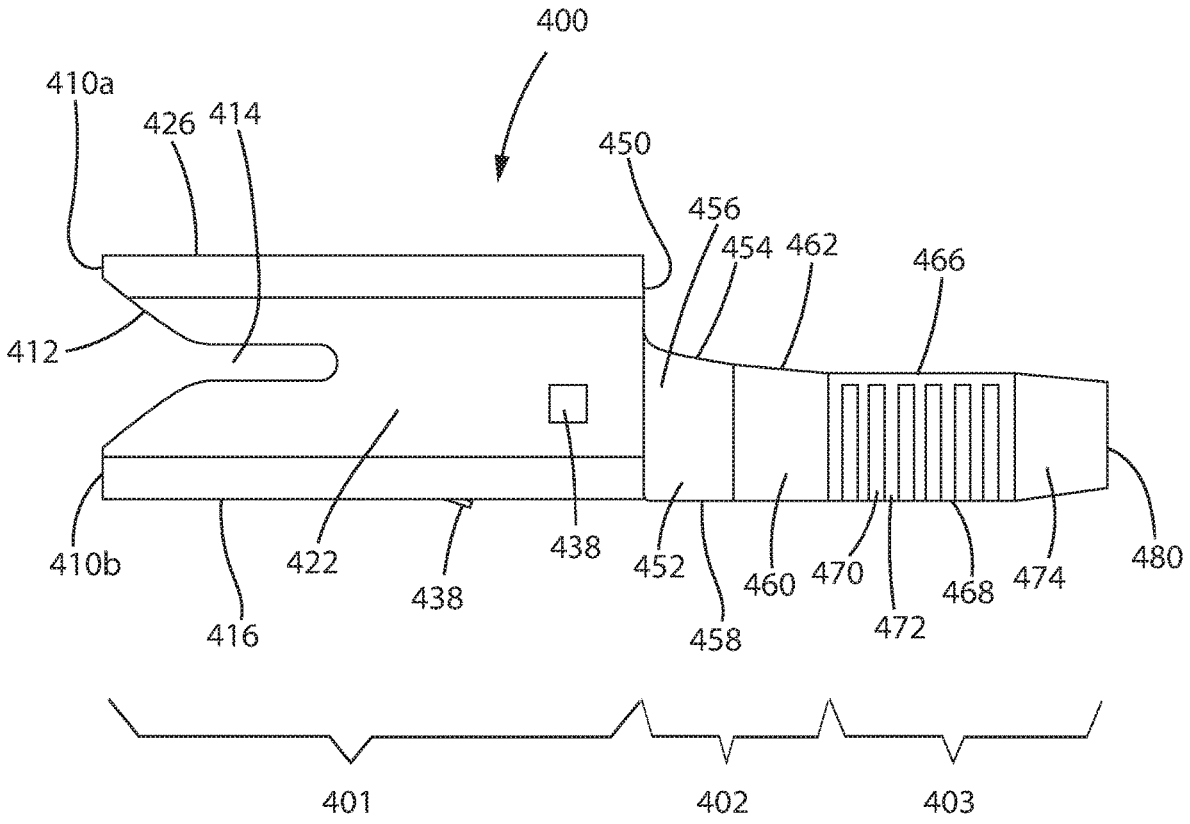

FIGS. 3B, 3C, 3D, 3E, 3F, and 3G are top elevation views of other embodiments of an IDC header pin of the present invention;

FIG. 4 is a side elevation view of one embodiment of the IDC header pin of the present invention;

FIG. 5 is a perspective view of another embodiment of the IDC header pin of the present invention;

FIG. 6 is a front elevation view of another embodiment of the IDC header pin of the present invention;

FIG. 7A is a top elevation view of another embodiment of the IDC header pin of the present invention;

FIGS. 7B, 7C, 7D, 7E, 7F, and 7G are top elevation views of other embodiments of an IDC header pin of the present invention;

FIG. 8 is a side elevation view of another embodiment of the IDC header pin of the present invention;

DETAILED DESCRIPTION OF THE INVENTION

The present invention provides an IDC pin for use in a connection system.

Embodiment 1

Figure 1:
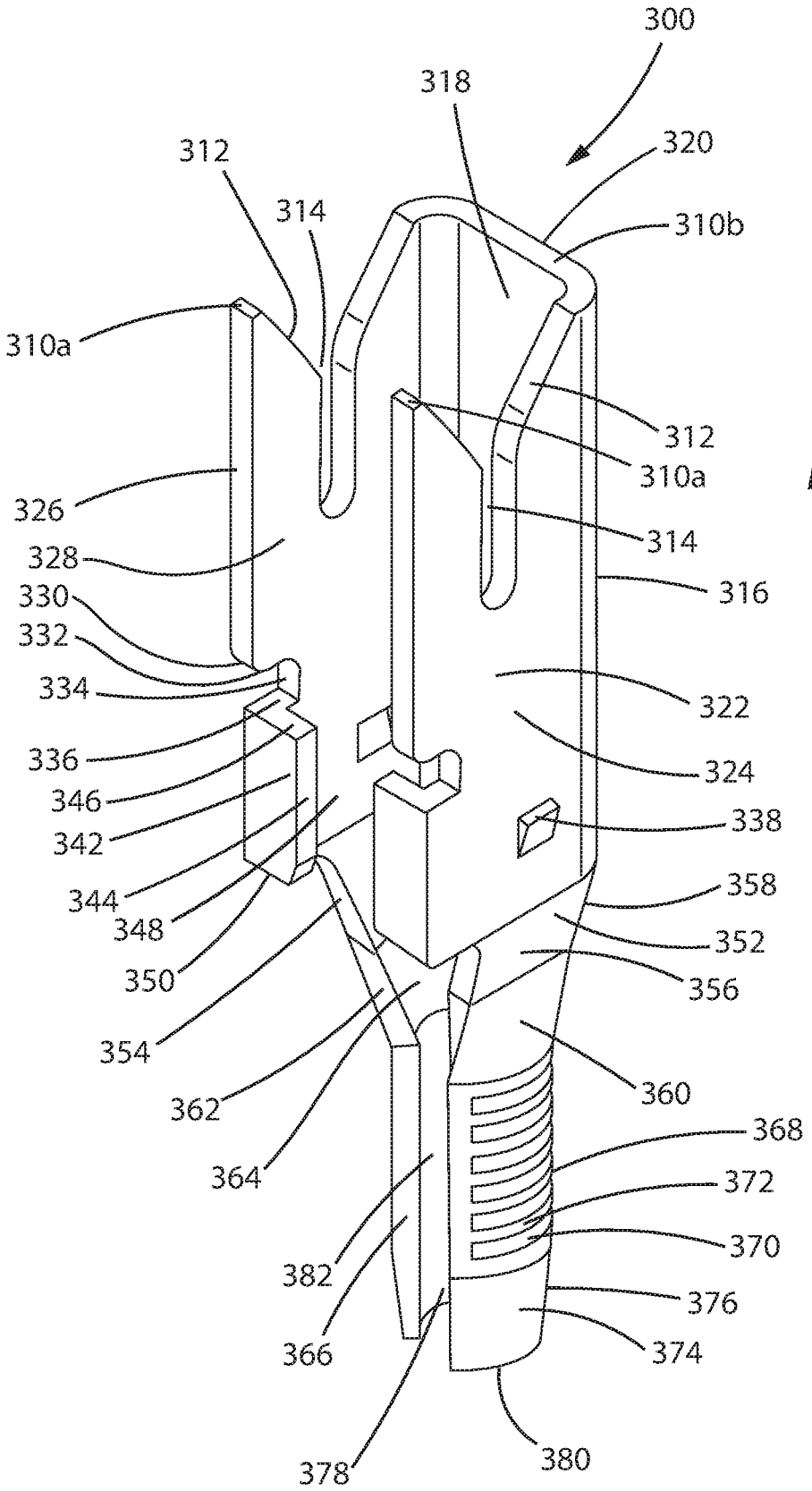
FIG. 1 is a perspective view of one embodiment of the MC header pin of the present invention.
Figure 2:
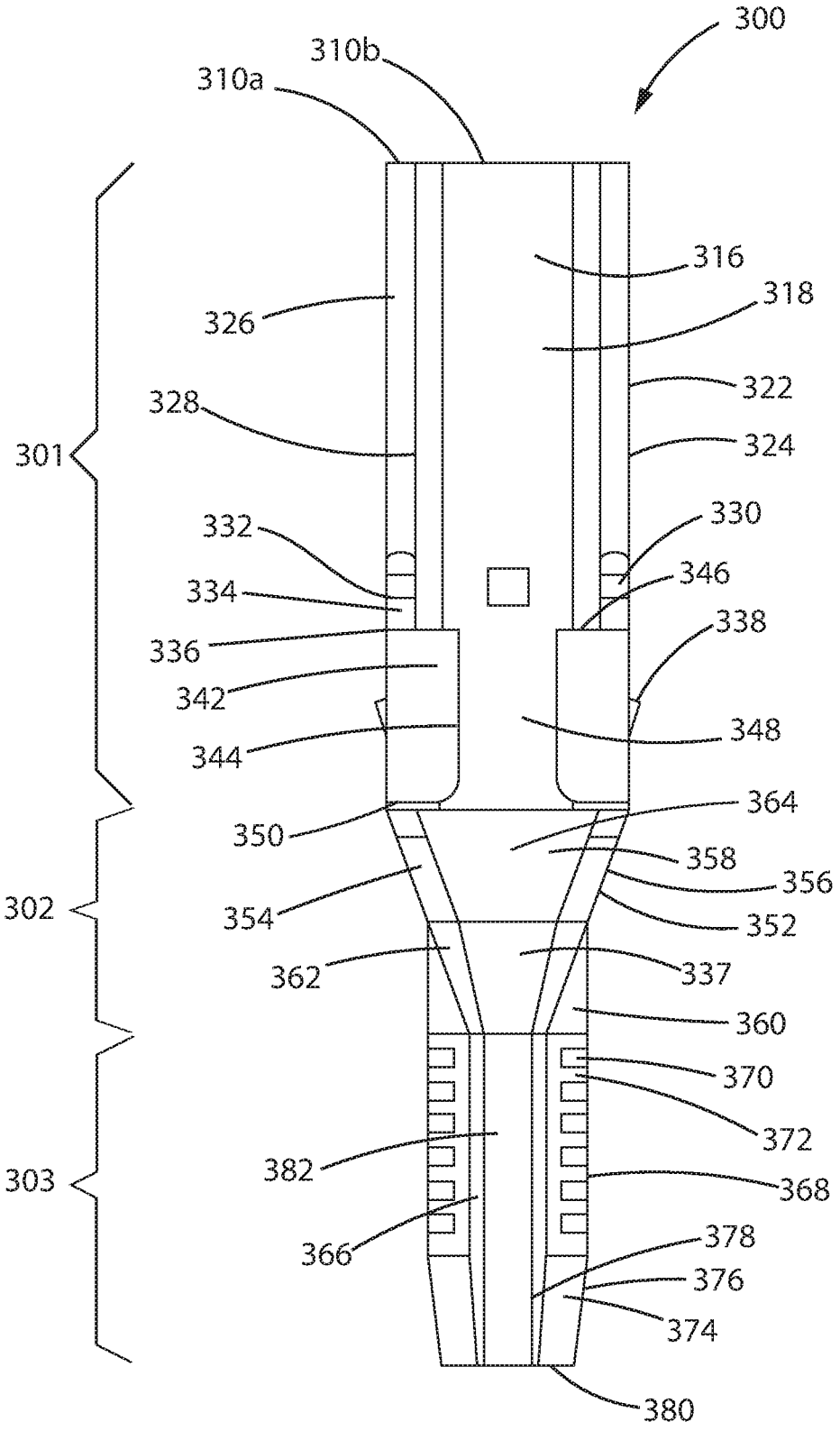
FIG. 2 is a front elevation view of one embodiment of the IDC header pin of the present invention.
Figure 3A:
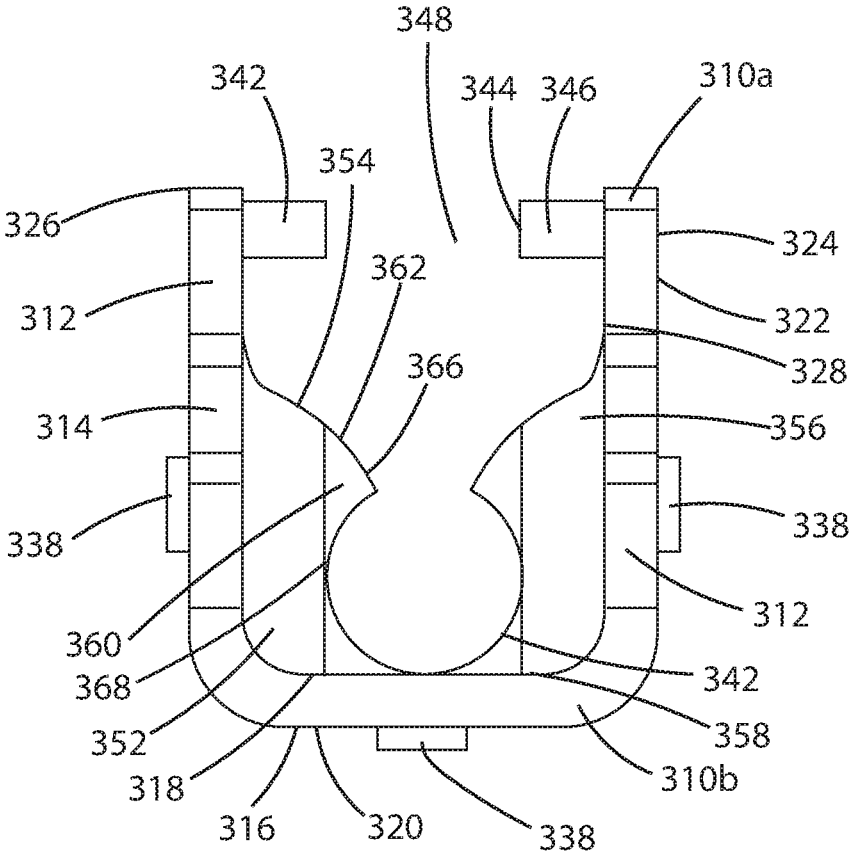
FIG. 3A is a top elevation view of one embodiment of the IDC header pin of the present invention.
Figure 3B:
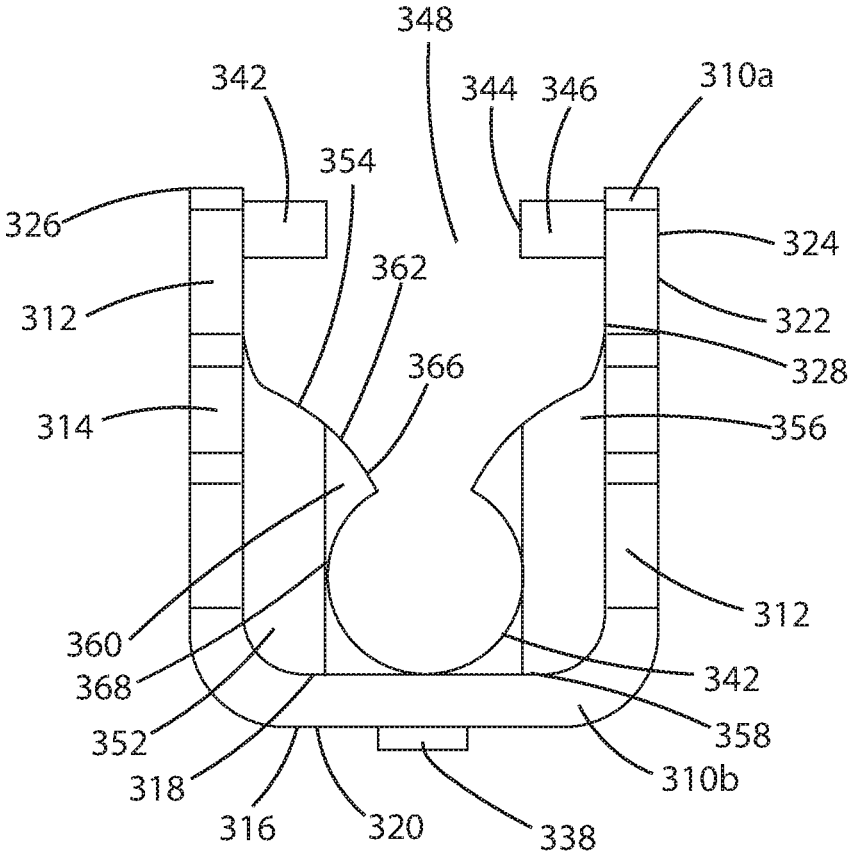
Figure 3C:
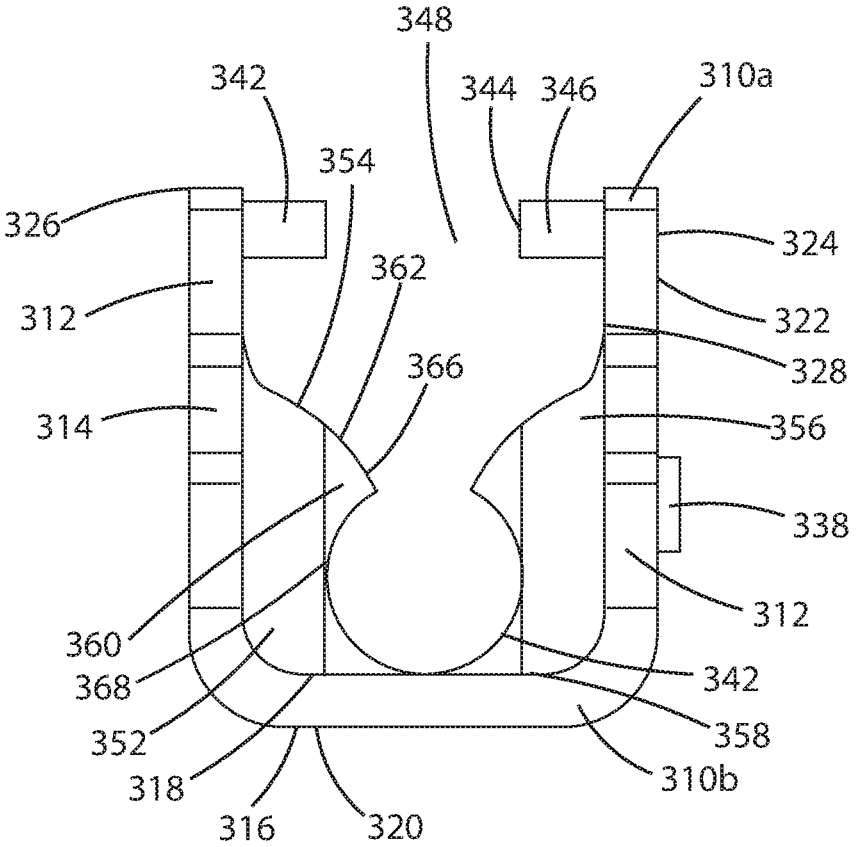
Figure 3D:
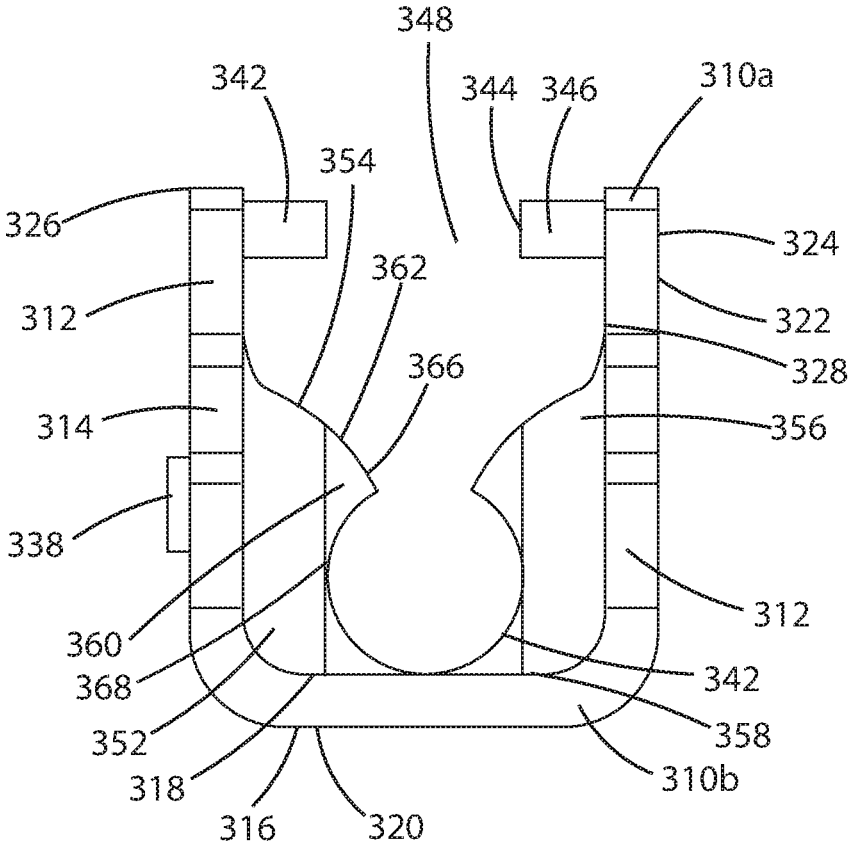
Figure 3E:
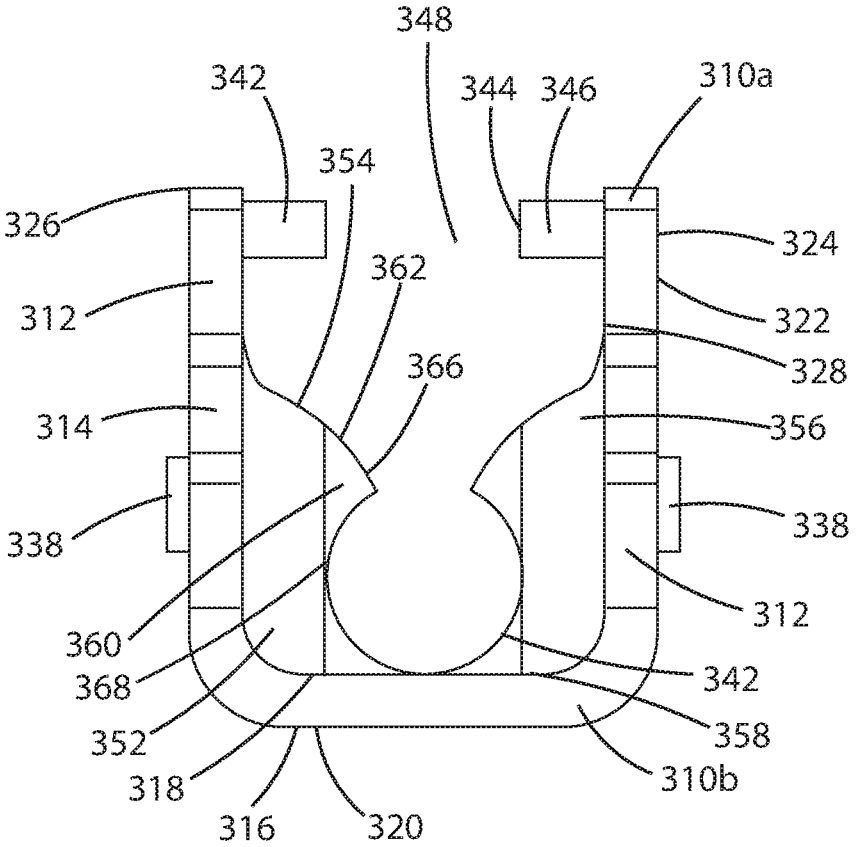
Figure 3F:
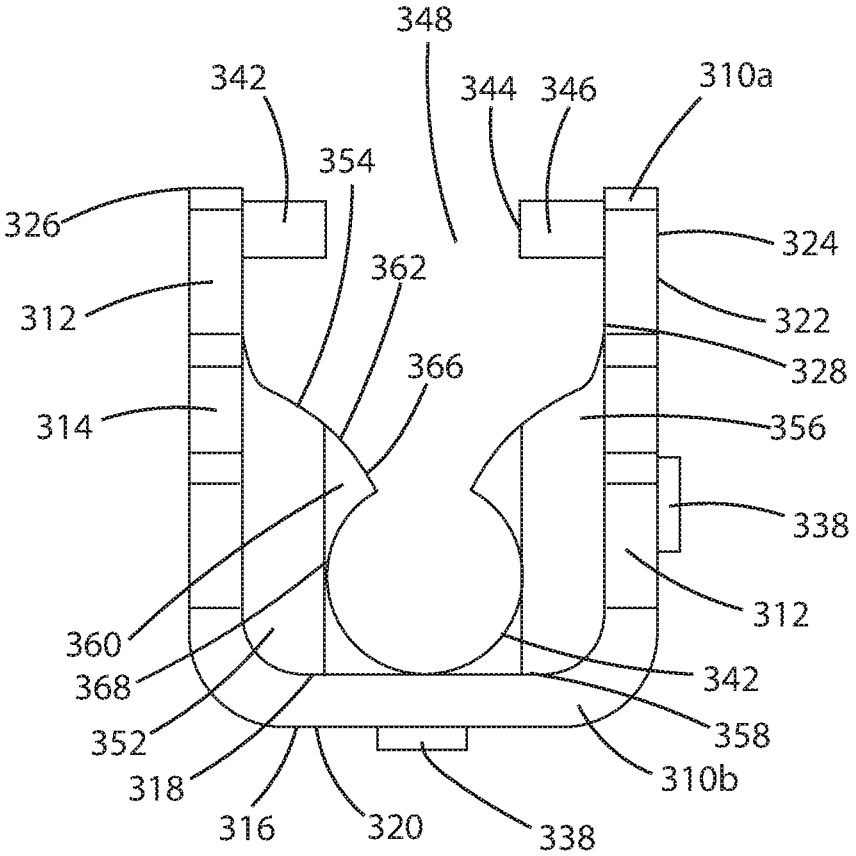
Figure 3G:
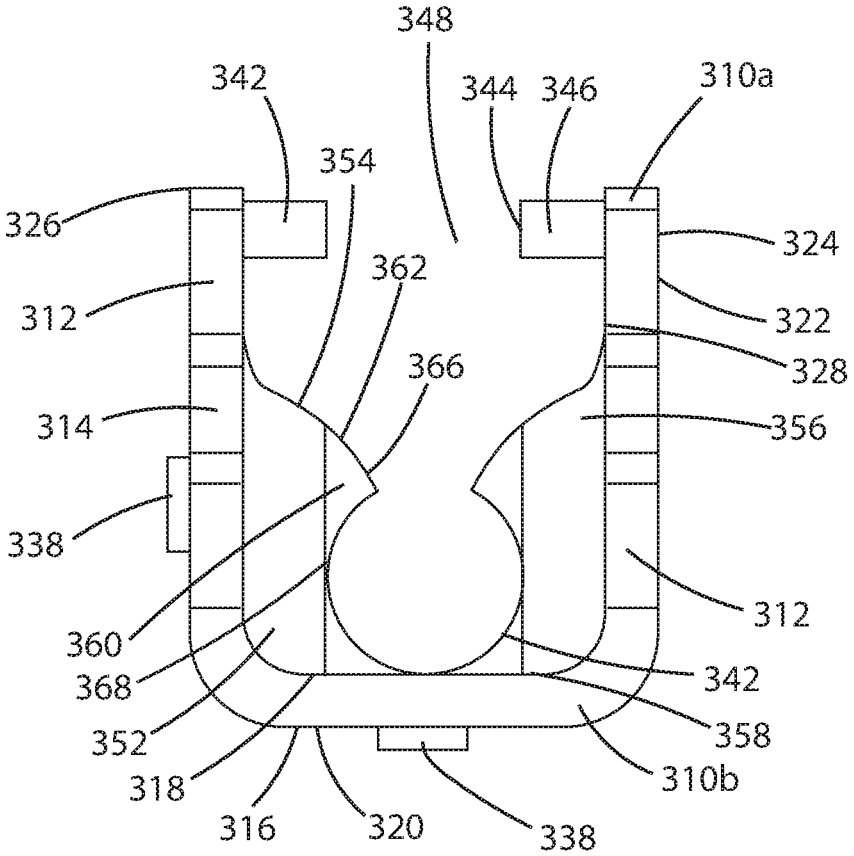

As shown in FIG. 1, the IDC header pin 300 can be considered to have a lengthwise direction, and can be considered to have three sections: an upper section 301, a lead-in section 302, and a retention section 303 (see FIG. 2, 4). The upper section 301 of the IDC header pin 300 has a back 316 and two sides 322 extending from the two outer ends of the back 316, being generally perpendicular to the inner surface 318 of the back 316 and forming a C-shape. The sides 322 and back 316 comprise the upper section 301. A plurality of pin barbs 338 extend outward from the outer surface 324 of each side 322, and at the rear surface 320 of the back 316. Pin barbs 338 are known in the art and function to anchor and retain the IDC header pin 300 when inserted into a housing, preventing it from being withdrawn. It is possible for the IDC header pin to have only a single first pin barb 338 (see FIG. 3B, 3C, 3D) and any additional pin barbs 338 (see FIG. 3E, 3F, 3G), but generally a pair of pin barbs 338 on opposite sides of the upper section 301 and on back 316 will be present (see FIG. 3A) to provide a sufficient anchoring into a housing. The pin barbs 338 are molded portions of the upper section and can be arranged in any manner, from one to three, but not limited thereto.

In upper section 301, at one end, in the lengthwise direction of the IDC header pin 300 are front IDC flat 310*a*, and rear IDC flat 310*b*. Front IDC flat 310*a*, and rear IDC flat 310*b* are comprised of flat regions generally perpendicular to the lengthwise direction of IDC header pin 300. Front IDC flat 310*a* is formed by the top surface of sides 322. Rear IDC flat 310*b* is formed by the top surface of the back 322 and top surface of sides 322. The front IDC flat 310*a* and rear IDC flat 310*b* are surfaces on which a machine/jig can apply force to the IDC header pin 300 to insert it into a housing. At the opposite end of the IDC header pin 300, in the lengthwise direction, is tip 352.

In upper section 301, (as in FIG. 1-4), are two IDC blades 312. IDC blades 312 are known in the art and are capable of cutting into the wire jacket of a wire conductor to make non-damaging electrical contact with a wire conductor. The IDC blades 312, form a dual contact with a wire, contacting a wire in two locations. The IDC blades 312 are generally parallel with the lengthwise direction of the pin 300 and are formed into each side 322 respectively. The two blades 312 may be mirror images of each other. Each IDC blade 312 is generally of a horseshoe shape with a gap 314 between the blade 312.

As shown in more detail in FIG. 3, IDC header pin 300 has back 316, and two sides 322 extending from opposite ends of the back 316 oriented generally perpendicular to the back 316, thereby forming a "C-shape" to the upper section 301. The two sides 322 may be mirror images of each other. The sides 322 are generally of a uniform thickness. At the end 326 of each side 322 is a notch 330 (see FIGS. 1, 3, 4) and a front protrusion 342, each notch 330 having a C-shape with the upper surface 332 and lower surface 336 of the notch 330 each meeting the back surface 334 of the notch 330 generally perpendicularly. Each front protrusion 342 extends from the lower surface 336 of the notch 330 and extends from the inner surface 328 of the side 322 and at the end 3326 of each side 322 thereof. As seen in more detail in FIG. 1, the front protrusions 342 are generally perpendicular to the sides 322 and parallel with the back 316, and are generally of a uniform thickness. The front protrusions 342 may be mirror images of each other. The sides 344 of each front protrusion 342 generally face the other, and are generally parallel to the other, with a gap 348 there between. Each front protrusion 342 creates a ledge structure, having the top surface 346 of the front protrusion 342 facing in an upward direction generally perpendicular to the lengthwise direction of the IDC header pin 300.

Formed by the lower surface of the front protrusion 342 and the lower surface of the side 322 (i.e., in the direction toward tip 380), is forward stop 350 (see FIG. 1). As in FIG. 4, forward stop 350 is a generally flat region generally perpendicular to the lengthwise direction of the IDC header pin 300, and faces generally toward tip 380. Forward stop 350 functions to end forward motion of the IDC header pin 300 when inserted into a housing, and defines the position of the DC header pin 300 when fully inserted in a housing.

At the lower end of upper section 301, is lead-in section 302. As in FIG. 2, lead-in section 302 has two walls, an upper wall 352 and lower wall 360. The upper end of the upper wall 352 extends from the lower end of the back 316 and a portion of the lower end of sides 316, of upper section 301. The upper wall 352 sides 356 are angled upward from the lower wall 360, and create a "tapered shape" to the lead-in section 302. As seen in FIG. 1, the upper wall 352 is narrowly tapered, with the sides 356 of the upper wall 352 narrowly tapering from where the upper wall 352 meets a portion of the lower end of each side 316, to where the upper wall 352 meets the upper end of the lower wall 360, the upper wall 334 having a uniform thickness. As in FIG. 4, the back 358 of the upper wall 352 is generally parallel to the back 316 of upper portion 301. As shown in more detail in FIG. 3, the lower wall 360 has a narrowly tapered shape, with the lower wall 360 narrowly tapering, from where the lower wall 360 meets the corner of the back 358 and sides 3356 of upper wall 352 to where the lower wall 360 meets the upper end of the retention section 303; and additionally tapering from where the lower wall 360 meets a front portion of the sides 356 of the upper wall 352 to where the lower wall 360 meets the upper end of the retention section 303. The lower wall 360 has a uniform thickness. As in FIG. 2, the upper wall edge 354 and lower wall edge 362 extend along the lengthwise direction of the IDC header pin 300 of the upper wall 352 and lower wall 360 respectively. The upper wall edges 354 are formed beginning at the lower end of the upper section 301, and extend to the upper end of the lower wall edges 362, along the lengthwise direction of the IDC pin 300. The lower wall edges 362 are formed beginning at the lower end of the upper wall edges 354, and extend to the upper end of the retention section edges 366. The lead-in section 302 has a front opening 364, defined by the gap between the upper wall edges 354, and additionally the gap between the lower wall edges 362. The lead-in section 302 serves to lead the IDC header pin 300 into a housing and thereby prevent stubbing of the MC header pin 300 during insertion into a housing.

At the lower end of the lead-in section 302, is the retention section 303. The retention section 303 extends in the lengthwise direction of the IDC header pin 300 from the lower end of lead-in section 302 and includes a cylindrical shape barrel-like portion 368, a plurality of rib-like projections 370, as well as a pin lead-in chamfer 374 and a tip 380 (see FIG. 2). The tip 380 is the surface generally perpendicular to the lengthwise direction of the IDC header pin 300, formed at the lower end of the pin lead-in chamfer 374. As in FIG. 1, the rib-like projections 370 surround and follow the outer surface the of the barrel-like portion 368 in a circumferential direction, generally perpendicular to the lengthwise direction of IDC header pin 300. The rib-like projections 370 are located away from the retention section edges 366 (See FIG. 2). The retention section 303 additionally has at least a gap 372 between each of the rib-like projections 370. The rib-like projections 370 enable the retention section 303 to make an interference fit with a PCB by contacting the inner surface of a hole in a PCB.

The retention section edges 366 of retention section 303 are generally parallel to the lengthwise direction of the IDC header pin 300. As in FIG. 2, the retention section edges 366 are formed beginning at the lower end of the lower wall edges 362 of the lead-in section 302, and extend to the tip 380 of the retention section 303, along the lengthwise direction of the IDC header pin 300. The retention section 303 also has a front opening 382, defined by the gap between the retention section edges 366.

As seen in FIG. 1, 2 at the lower end of the barrel-like portion 368, toward tip 380, is pin lead-in chamfer 374. The pin lead-in chamfer 374 is angled to prevent stubbing of the IDC header pin 300 when it is inserted into and through a housing or a hole in a printed circuit board. The pin lead-in chamfer 374 has a conical or funnel-like shape exterior surface 376, extending upward from where the lower end of the pin lead-in chamfer 374 meets the tip 380 to where the pin lead-in chamfer 374 meets the barrel-like portion 368. The inner surface 378 of the pin lead-in chamfer 374 is generally parallel with the lengthwise direction of the IDC header pin 400. The exterior surface 376 of the pin lead-in chamfer 374 narrowly tapers from where the exterior surface 376 of the pin lead-in chamfer 374 meets the lower end of the barrel-like portion 368 to where the exterior surface 376 of the pin lead-in chamfer 374 meets the tip 380, with a decrease in thickness of the pin lead-in chamfer 374 toward the tip 380 (see FIG. 2).

Embodiment 2

As shown in FIG. 5, the IDC header pin 400 can be considered to have a lengthwise direction, and can be considered to have three sections: an upper section 401, a lead-in section 402, and a retention section 403 (see FIG. 6, 8). The upper section 401 of the IDC header pin 400 has a back 416 and two sides 422 extending from the two outer ends of the back 416, being generally perpendicular to the inner surface 418 of the back 416 and forming a C-shape. The sides 422 and back 416 comprise the upper section 401. A plurality of pin barbs 438 extend outward from the outer surface 424 of each side 422 and the rear surface 420 of the back 416. Pin barbs 438 are known in the art and function to anchor and retain the IDC header pin 400 when inserted into a housing, preventing it from being withdrawn. It is possible for the IDC header pin to have only a single first pin barb 438 (see FIG. 7B, 7C, 7D) and any additional pin barbs FIG. 7E, 7F, 7G), but generally a pair of pin barbs 438 on opposite sides of the upper section 401 and on back 416 will be present (see FIG. 7A) to provide a sufficient anchoring into a housing. The pin barbs 438 are molded portions of the upper section and can be arranged in any manner, from one to three, but not limited thereto.

In upper section 401, at one end, in the lengthwise direction of the IDC header pin 400 is front IDC flat 410*a* and rear IDC flat 410*b*. Front IDC flat 410*a*, and rear IDC flat 410*b* are comprised of flat regions generally perpendicular to the lengthwise direction of IDC header pin 400. Rear IDC flat 410*b* is formed by the top surface of the back 416 and top surface of each side 422. Front IDC flat 410*a* is formed by the top surface of sides 422 and top of front walls 432*a*, 432*b*. The front IDC flat 410*a*, and rear IDC flat 410*b* are surfaces on which a machine/jig can apply force to the IDC header pin 400 to insert it into a housing. At the opposite end of the IDC header pin 400, in the lengthwise direction, is tip 480.

In upper section 401, (as in FIG. 5-8), are two IDC blades 412. IDC blades 412 are known in the art and are capable of cutting into the wire jacket of a wire conductor to make non-damaging electrical contact with a wire conductor. The IDC blades 412, form a dual contact with a wire, contacting a wire in two locations. The IDC blades 412 are generally parallel with the lengthwise direction of the IDC header pin 400 and are formed into each side 422, respectively. The two blades 312 may be mirror images of each other. Each IDC blade 412 is generally of a horseshoe shape with a gap 414 between the blade 412.

As shown in more detail in FIG. 7, IDC header pin 400 has back 416, and two sides 422. extending from opposite ends of the back 416 oriented generally perpendicular to the back 416, thereby forming a "C-shape" to the upper section 401. The two sides 422 may be mirror images of each other. The sides 422 are generally of a uniform thickness. Front walls 432*a*, 432*b* extend from the end 426 of the sides 422, are generally perpendicular to the sides 422 and parallel with the back 416. The front walls 432*a*, 432*b* are generally of a uniform thickness. As seen in FIG. 6, the front walls 432*a*, 432*b*, create a "closed" front to the upper section 401, with each respective side 434*a*, 434*b*, of each front wall, 432*a*, 432*b* generally facing each other, and with a small opening 440 there between. Front wall 432*a*, extends from the inner surface 428 and at the end 426 of a side 422. Front wall 432*b* extends from the inner surface 428 and at the end 426 of a side 416. Front wall 432*a* has a protrusion 442 extending outward in a direction generally parallel with front wall 432*a* and front wall 432*b*. The protrusion 442 extending from front wall 432*a* is surrounded by and extends into a notch 430 in front wall 432*b*. The notch 430 of front wall 432*b* is similarly shaped to protrusion 442 of front wall 432*a*.

Formed by the lower surface of the front walls 432*a*, 432*b* and the lower surface of the sides 422 (i.e., in the direction toward tip 480), is forward stop 450 (see FIG. 5). As in FIG. 8, forward stop is a generally flat region generally perpendicular to the lengthwise direction of the IDC header pin 400, and faces generally toward tip 480. Forward stop 450 functions to end forward motion of the IDC header pin 400 when inserted into a housing, and defines the position of the IDC header pin 400 when fully inserted in a housing.

At the lower end of upper section 401, is lead-in section 402. As in FIG. 6, lead-in section 402 has two walls, an upper wall 452 and lower wall 460. The upper end of the upper wall 452 extends from the lower end of the back 416 and a portion of the lower end of sides 422, of upper section 401. The upper wall 452 sides 456 are angled upward from the lower wall 460, and create a "tapered shape" to the lead-in section 402. As seen in FIG. 5, the upper wall 452, is narrowly tapered, with the sides 456 of the upper wall 452 narrowly tapering from where the upper wall 452 meets a portion of the lower end of each side 422, to where the upper wall 452 meets the upper end of the lower wall 460, the upper wall 452 having a uniform thickness. As in FIG. 8, the back 458 of the upper wall is generally parallel to the back 416 of upper portion 401. As shown in more detail in FIG. 7, the lower wall 460 has a narrowly tapered shape, with the lower wall 460 narrowly tapering, from where the lower wall 460 meets the corner of the back 458 and sides 456 of upper wall 452 to where the lower wall 460 meets the upper end of the retention section 403; and additionally tapering from where the lower wall 460 meets a front portion of the sides 456 of the upper wall 452 to where the lower wall 460 meets the upper end of the retention section 403. The lower wall 460 has a uniform thickness. As in FIG. 6, the upper wall edges 454 and lower wall edges 462 extend along the lengthwise direction of the IDC header pin 400 of the upper wall 452 and lower wall 460 respectively. The upper wall edges 454 are formed beginning at the lower end of the upper section 401, and extend to the upper end of the lower wall edges 4462, along the lengthwise direction of the IDC pin 400. The lower wall edges 462 are formed beginning at the lower end of the upper wall edges 454, and extend to the upper end of the retention section edges 466. The lead-in section 402 has a front opening 464, defined by the gap between the upper wall edges 454, and additionally the gap between the lower wall edges 462. The lead-in section 402 serves to lead the IDC header pin 400 into a housing and thereby prevent stubbing of the IDC header pin 400 during insertion into a housing.

At the lower end of the lead-in section 402, is the retention section 403. The retention section 403 extends in the lengthwise direction of the IDC header pin 400 from the lower end of lead-in section 402 and includes a cylindrical shape barrel-like portion 468, a plurality of rib-like projections 470, as well as a pin lead-in chamfer 474 and a tip 480 (see FIG. 6). The tip 480 is the surface generally perpendicular to the lengthwise direction of the IDC header pin 400, formed at the lower end of the pin lead-in chamfer 474. As in FIG. 5, the rib-like projections 470 surround and follow the outer surface the of the barrel-like portion 468 in a circumferential direction, generally perpendicular to the lengthwise direction of IDC pin 400. The rib-like projections 470 are located away from the retention section edges 466 (see FIG. 6). The retention section 403 additionally has at least a gap 472 between each of the rib-like projections 470. The rib-like projections 470 enable the retention section 403 to make an interference fit with a PCB by contacting the inner surface of a hole in a PCB.

The retention section edges 466 of retention section 403 are generally parallel to the lengthwise direction of the IDC header pin 400. As in FIG. 6, the retention section edges 466 are formed beginning at the lower end of the lower wall edges 462 of the lead-in section 402, and extend to the tip 480 of the retention section 403, along the lengthwise direction of the IDC pin 400. The retention section 403 also has a front opening 482, defined the gap between the retention section edges 466.

As seen in FIG. 5, 6 at the lower end of the barrel-like portion 468, toward tip 480, is pin lead-in chamfer 474. The pin lead-in chamfer 474 is angled to prevent stubbing of the header pin 400 when it is inserted into and through a housing or a hole in a printed circuit board. The pin lead-in chamfer 474 has a conical or funnel-like shape exterior surface 476, extending upward from where the lower end of the pin lead-in chamfer 474 meets the tip 480 to where the pin lead-in chamfer 474 meets the barrel-like portion 468. The inner surface 478 of the pin lead-in chamfer 475 is generally parallel with the lengthwise direction of the IDC header pin 400 (see FIG. 5). The exterior surface 476 of the pin lead-in chamfer 474 narrowly tapers from where the exterior surface 476 of the pin lead-in chamfer 474 meets the lower end of the barrel-like portion 468 to where the exterior surface 476 of the pin lead-in chamfer 474 meets the tip 480, with a decrease in thickness of the pin lead-in chamfer 474 toward the tip 480.

As will be appreciated by those of skill in the art, the IDC header pin, of the present invention, may be used in a wide variety of applications, including applications in which IDC connectors are conventionally used. For example, these pins may be used in automotive applications.

Although the invention has been described with respect to specific embodiments, it will be appreciated that the invention is intended to cover all modifications and equivalents within the scope of the following claims.

LIST OF REFERENCE NUMERALS

300 IDC Header Pin
301 Upper Section
302 Lead-In Section
303 Retention Section
310*a* Front IDC Flat
310*b* Rear IDC Flat
312 IDC Blade
314 Gap
316 Back of Upper Section
318 inner Surface of the Back
320 Rear Surface of Back
322 Side of Upper Section
324 Outer Surface of Side
326 End of Side
328 Inner Surface of Side
330 Notch of Upper Section
332 Upper Surface of Notch
334 Back Surface of Notch
336 Lower Surface of Notch
338 Pin Barb
342 Front Protrusion
344 Side of Front Protrusion
346 Top Surface of Protrusion
348 Gap
350 Forward Stop
352 Upper Wall
354 Edges of Upper Wall
356 Side of Upper Wall
358 Back of Upper Wall
360 Lower Wall
362 Edges of Lower Wall
364 Front Opening of Lead-in Section
366 Edges of Retention Section
368 Barrel-like Portion
370 Rib-like Projections
372 Gap
374 Pin Lead-in Chamfer
376 Exterior Surface of Pin Lead-in Chamfer
378 Inner Surface of Pin Lead-in Chamfer
380 Tip
382 Front Opening of Retention Section
400 IDC Header Pin
401 Upper Section
402 Lead-In Section
403 Retention Section
410*a* Front IDC Flat
410*b* Rear IDC Flat
412 IDC Blade
414 Gap
416 Back of Upper Section
418 Inner Surface of the Back
420 Rear Surface of Back.
422 Side of Upper Section
424 Outer Surface of Side
426 End of Side
428 inner Surface of Side
430 Notch of Front Wall
432*a* Front Wall
432*b* Front Wall
434*a* Side of Front Wall
434*b* Side of Front Wall
438 Pin Barb

440 Opening of Upper Portion
442 Protrusion of Front Wall
450 Forward Stop
452 Upper Wall
454 Edges of Upper Wall
456 Side of Upper Wall
458 Back of Upper Wall
460 Lower Wall
462 Edges of Lower Wall
464 Front Opening of Lead-in Section
466 Edges of Retention Section
468 Barrel-like Portion
470 Rib-like Projections
472 Gap
474 Pin Lead-in Chamfer
476 Exterior Surface of Pin Lead-in chamfer
478 inner Surface of Pin Lead-in chamfer
480 Tip
482 Front Opening of Retention Section

We claim:

1. An insulation displacement contact header pin, comprising:

a substantially c-shaped upper section, having a first side, a second side, and a back side, and the upper section having at least a pin barb thereon, wherein the first side and the second side each extend substantially perpendicular from the back side, the first side and the second side being substantially mirror images, wherein the first side has a blade formed therein, and the second side has a blade formed therein, wherein the blade of each of the first side and the second side has a respective slot formed therein, the slot extending substantially parallel along the lengthwise direction of the upper section, and the upper section having a forward stop, wherein the forward stop is a pair of flat regions of the upper section extending in a direction substantially perpendicular to the lengthwise direction of the upper section, a lead-in section, having a tapered shape and being below the forward stop, wherein the lead-in section extends from a portion of the upper section, the lead-in section having a first wall portion and a second wall portion, wherein the first wall portion of the lead-in section has a substantially uniform thickness, extending from the back and each of the first side and the second side, a back portion of the first wall being substantially parallel to the back of the upper portion, a portion of the first wall portion having sides of the first wall portion which are narrowly tapered from the sides of the upper section in a direction towards where the sides of the first wall portion meet the second wall portion, wherein the second wall portion has a substantially uniform thickness, extending from the entirety of the first wall portion, the second wall portion having a narrowly tapered shape, and having sides of the second wall portion which are narrowly tapered from the sides and the back portion of the first wall portion in a direction towards where the second wall portion meets a retention section, wherein the first wall portion has at least an edge extending along the lengthwise direction of the lead-in section, wherein the at least an edge of the first wall portion defines an edge of a front opening of the lead-in section, wherein the at least an edge of the second wall portion defines an opposing edge of the front opening of the lead-in section, the edges opposing each other, the retention section having a barrel-like portion, a plurality of projections protruding from the barrel-like portion, a pin lead-in chamfer being an angled surface, and the retention section having a tip defining an end surface of the insulation displacement contact header pin and being substantially perpendicular to the lengthwise direction of the retention section, wherein the retention section has at least an edge extending along the lengthwise direction of the retention section, the edge connected to the at least an edge of the second wall portion of the lead-in section, and extending to the tip of the retention section, wherein the retention section also has a front opening, and wherein the front opening of the retention section is defined by the at least an edge of the second wall portion, having one of at least an edge left of the front opening, and having another one of an edge right of the front opening, the edges opposing each other, the forward stop of the upper section extending in a direction substantially perpendicular to the lengthwise direction of the upper section, and the forward stop extending further outward than the lead-in section, and extending further outward than the retention section.

2. The insulation displacement contact header pin according to claim 1, wherein the lead-in chamfer of the retention section is substantially conical in shape.

3. The insulation displacement contact header pin according to claim 1, wherein the upper section further comprises a front opening, wherein the front opening of the retention section is defined by at least a front wall, having a portion of the front wall left of the front opening, and having another portion of the front wall right of the front opening, the front wall portions opposing each other; and wherein the at least a front wall is substantially perpendicular to the left side and right side of the upper section, and substantially parallel with the back.

4. The insulation displacement contact header pin according to claim 2, wherein the upper section further comprises a front opening, wherein the front opening of the retention section is defined by at least a front wall, having a portion of the front wall left of the front opening, and having another portion of the front wall right of the front opening, the front wall portions opposing each other, and wherein the at least a front wall is substantially perpendicular to the left side and right side of the upper section, and substantially parallel with the back.

5. The insulation displacement contact header pin according to claim 1, wherein the upper section further comprises a front protrusion, extending substantially perpendicular from either the left side or right side of the upper section, and being substantially parallel to the back wall of the upper section.

6. The insulation displacement contact header pin according to claim 2, wherein the upper section further comprises a front protrusion, extending substantially perpendicular from either the left side or right side of the upper section, and being substantially parallel to the back wall of the upper section.

7. The insulation displacement contact header pin of claim 1, wherein the upper section comprises a second pin barb thereon.

8. The insulation displacement contact header pin of claim 2, wherein the upper section comprises a second pin barb thereon.

9. The insulation displacement contact header pin of claim 1, wherein the upper section comprises a pair of the first pin barbs on opposite sides of the upper section.

10. The insulation displacement contact header pin of claim 2, wherein the upper section comprises a pair of the first pin barbs on opposite sides of the upper section.

* * * * *